US006761356B1

(12) United States Patent
Jacobson et al.

(10) Patent No.: US 6,761,356 B1
(45) Date of Patent: Jul. 13, 2004

(54) EDUCATIONAL CARD GAME

(76) Inventors: William Jacobson, 939 E. Calle del Norte, Chandler, AZ (US) 85225; Amanda Kohout, 939 E. Calle del Norte, Chandler, AZ (US) 85225

( * ) Notice: Subject to any disclaimer, the term of this patent is extended or adjusted under 35 U.S.C. 154(b) by 0 days.

(21) Appl. No.: 10/280,628

(22) Filed: Oct. 26, 2002

(51) Int. Cl.[7] ..... A63F 9/20
(52) U.S. Cl. ..... 273/292
(58) Field of Search ..... 273/292, 236, 273/240, 429–432, 440, 445, 447

(56) References Cited

U.S. PATENT DOCUMENTS

| | | | | | |
|---|---|---|---|---|---|
| 895,303 | A | * | 8/1908 | Rosenberger | 273/153 R |
| 984,302 | A | * | 2/1911 | Rosenberger | 273/153 R |
| 1,754,738 | A | * | 4/1930 | Calle | 273/240 |
| 2,280,609 | A | * | 4/1942 | Williamson | 273/157 A |
| 3,394,935 | A | * | 7/1968 | Beauchaine | 273/240 |
| 3,419,971 | A | * | 1/1969 | Ribken | 434/88 |

(List continued on next page.)

*Primary Examiner*—Delores R. Collins

(57) ABSTRACT

The present invention is a game that challenges a plurality of participants to win points by verbally describing images, accurately recreating images based on verbal descriptions, and evaluating images based on preexisting criteria. A set of game cards is provided, and each game card includes on its front face a unique image, an image title, and a plurality of unique written criteria. Each criterion is a true statement of a descriptive nature pertaining to the image on the same game card. The criteria are not initially visible to any participant. The game is played in multiple rounds, where in each round, one participant verbally describes the image on a game card while the remaining participants attempt to recreate the image on a writing surface based on the verbal description. After an allotted time, the description is concluded and participants stop recreating the image. Participants exchange their recreated images and evaluate the images they receive based upon whether or not the plurality of criteria associated with the image are satisfied. Points are awarded to the participant who described the image as well as all participants who recreated the image based upon the number of criteria that are satisfied. Bonus points and an element of randomness are provided by the bonus criteria. The winner of the game is the participant that accumulates the most points during all rounds of the game.

8 Claims, 5 Drawing Sheets

U.S. PATENT DOCUMENTS 3,618,231 A * 11/1971 Nason ..... 273/295
4,109,918 A * 8/1978 Mele et al. ..... 273/256
4,378,942 A * 4/1983 Isaac ..... 273/278
4,637,799 A * 1/1987 Bouchal ..... 434/236
4,850,595 A * 7/1989 Sherman et al. ..... 273/240
5,000,460 A * 3/1991 Barbiaux et al. ..... 273/245
5,054,775 A * 10/1991 Banks et al. ..... 273/431
5,071,133 A * 12/1991 Smith ..... 273/248
5,076,588 A * 12/1991 Minh ..... 273/292
5,123,658 A * 6/1992 Elfanbaum ..... 273/430
5,145,183 A * 9/1992 Gates ..... 273/240
5,150,907 A * 9/1992 Desmarais et al. ..... 273/240
5,193,818 A * 3/1993 Leeson ..... 463/10
5,197,884 A * 3/1993 Roemer et al. ..... 434/178
5,217,231 A * 6/1993 Landis ..... 273/429
5,257,939 A * 11/1993 Robinson et al. ..... 434/129
5,318,306 A * 6/1994 Levin ..... 273/293
5,690,336 A * 11/1997 Oliver ..... 273/302
5,738,354 A * 4/1998 Easley ..... 273/249
5,741,561 A * 4/1998 Lenkin ..... 428/13
5,746,433 A * 5/1998 Klassen et al. ..... 273/302
5,769,715 A * 6/1998 Brown ..... 463/10
5,890,741 A * 4/1999 Hollander ..... 283/62
5,902,114 A * 5/1999 Erickson ..... 434/188
5,967,517 A * 10/1999 Villano ..... 273/292
6,070,872 A * 6/2000 Squitieri ..... 273/292
6,076,828 A * 6/2000 McGill ..... 273/292
6,109,609 A * 8/2000 Ekberg ..... 273/236
6,111,180 A * 8/2000 DiGiulio ..... 84/471 R
6,152,449 A * 11/2000 Lenkoff ..... 273/240
6,179,294 B1 * 1/2001 Turnali ..... 273/302
6,234,481 B1 * 5/2001 Robertson ..... 273/243
6,234,803 B1 * 5/2001 Watkins ..... 434/156
6,267,376 B1 * 7/2001 Jenkins ..... 273/258
6,279,909 B1 * 8/2001 Alexander et al. ..... 273/249
6,328,308 B1 * 12/2001 Kirby ..... 273/299
6,341,779 B1 * 1/2002 Merritt ..... 273/292
6,402,144 B1 * 6/2002 Ekberg ..... 273/239
6,402,152 B1 * 6/2002 Kutzik ..... 273/296
6,435,508 B1 * 8/2002 Tavel ..... 273/292
6,443,453 B1 * 9/2002 Wallice ..... 273/243
6,457,716 B1 * 10/2002 Johnson Prillerman ..... 273/296
6,497,410 B1 * 12/2002 Bernstein et al. ..... 273/297
6,533,278 B1 * 3/2003 Drastrup ..... 273/236
2002/0113373 A1 * 8/2002 Haas ..... 273/432
2003/0071419 A1 * 4/2003 Stuart ..... 273/430

* cited by examiner

EDUCATIONAL CARD GAME

CROSS-REFERENCE TO RELATED APPLICATIONS

Not applicable.

FEDERALLY SPONSORED RESEARCH

Not Applicable

SEQUENCE LISTING OR PROGRAM

Not Applicable

BACKGROUND OF THE INVENTION—FIELD OF INVENTION

The present invention is directed toward a competitive and/or educational game apparatus that involves the activities of verbally describing images, accurately recreating images based on verbal descriptions, and evaluating images based on preexisting criteria.

BACKGROUND OF THE INVENTION

In the past, hundreds of games have been created that use dice, cards, and scoring sheets or other writing surfaces. In particular, prior art includes games that test the artistic skills of participants. Previous games such as those marketed under the trademarks "Pictionary" and "Cranium" provide the name of an object (or place or action, etc.) on a game card and require a participant to draw the object (or place or action, etc.) on a writing surface while other participants attempt to deduce the combination of terms or expressions literally represented by the illustration. Examples of such games are disclosed in U.S. Pat. No. 5,607,160 to Stevens et al. (1997) and U.S. Pat. No. 6,279,909 to Alexander et al. (2001). However, these games do not require that participants describe an image or evaluate images based on preexisting criteria.

The prior art also includes games that test the interpretive skills of participants by requiring them to provide a short verbal answer given an illustration on a card. Examples of such games are disclosed in U.S. Pat. No. 4,890,844 to Weiss (1990) and U.S. Pat. No. 5,439,232 to Pollock (1995). Games such as the one marketed under the trademark "Stare!", include game cards displaying an image and require that participants answer questions about the image solely from memory. However, these games do not require that participants draw images or evaluate images based on preexisting criteria.

Previous games such as those marketed under the trademarks "Guess-a-Doodle" and "Skribble" require participants to verbally describe an image while other participants recreate the image and then attempt to guess what it is they have drawn. These games are limited in that the participant who is describing the image may use only a limited domain of "abstract" words (e.g. "circle", "square", "line", etc.) in the description they provide (so as to avoid unfairly giving the answer away). The images are extremely unsophisticated objects that are easy for young children to describe and draw. Such games have limited appeal to older participants who find them unchallenging and restrictive. Furthermore, these games do not require that participants evaluate images based on preexisting criteria.

No games have been proposed that call for participants to verbally describe a complex image using an unrestricted vocabulary in a limited time. Furthermore, no games have been proposed which require that the recreated images be evaluated against a series of preexisting criteria in order to win points.

Therefore there is a need for a game that stimulates participants to verbally describe images in a clear and concise manner so that others may recreate the image. By the same token, there is a need for a game that challenges participants to recreate an image based on an unrestricted verbal description. Finally, there is a need for a game that affords participants an opportunity to evaluate recreated images based upon preexisting criteria. Such a game would provide both entertainment as well as educational opportunities for participants to learn to clearly and concisely describe images, recreate images from a verbal description, and evaluate images based on descriptive criteria. Such a game should be presented in a manner that is both entertaining in an interactive atmosphere and intellectually stimulating to a wide variety of participants. The present invention is directed to fulfilling this need.

BACKGROUND OF THE INVENTION—OBJECTS AND ADVANTAGES

Thus a broad object of the present invention is to provide an intellectually stimulating game for participation by three or more participants.

Another object of the present invention is to provide a game of the character described in which participants are presented an opportunity to improve skills associated with concisely describing an image using an unrestricted vocabulary in a limited time such that other participants may accurately recreate said image.

Yet another object of the present invention is to provide a game of the character described in which participants are presented an opportunity to improve skills associated with artistically recreating an image based on a verbal description of said image in a limited time.

An additional object of the present invention is to provide a game of the character described in which participants are presented an opportunity to improve skills associated with evaluating an image based on a series of preexisting criteria that assert conditions pertaining to the image being evaluated.

Still another object of the present invention is to provide a game for both children and adults that is entertaining and amusing in an interactive setting.

A still further object of the present invention is to provide a game that is competitive in nature and includes elements of skill as well as elements of randomness.

These and other objects and advantages of the present invention, along with features of novelty appurtenant thereto, will appear or become apparent in the course of the ensuing description of a preferred embodiment, which is to be read in connection with the following drawings and the appended claims.

SUMMARY OF THE INVENTION

In accordance with the present invention, a game apparatus is provided for stimulating a plurality of participants to improve skills necessary to provide effective descriptions of images, accurately recreate images based on descriptions, and critically evaluate images based on sets of criteria.

The game apparatus includes a plurality of game cards and writing surfaces. Each game card includes on its front face a unique image, an image title, and a plurality of unique written criteria, each criterion being a true statement of a descriptive nature pertaining to the image on the same card. Each writing surface bears designated regions for recreating an image using a writing utensil based on a verbal description. Each writing surface further bears designated regions for recording the number of points received by a participant who recreated an image and a participant who verbally described an image.

A quantity of writing surfaces and a writing utensil is distributed to each participant.

Each participant is in turn designated as a describer with all other participants designated as artists. The describer selects an individual game card from the plurality of game cards. One criterion is selected by said describer, by some means which yields a random choice outside the describer's control, to be worth additional bonus points. Said describer reads aloud the title on the game card. Said describer then verbally describes the image on said game card in accordance with the time remaining as measured by the timing device. Using their writing utensil, the artists recreate the image on their writing surface based on the verbal description provided. When time has fully elapsed, the describer must immediately end the verbal description, and all artists must immediately stop recreating the image.

After time has elapsed, all artists exchange drawings among themselves such that no artist has the recreated image he or she made. The describer reads aloud each criterion one at a time in the order that they appear on the game card, giving pause between each such that the artists may judge whether or not the criterion has been satisfied by the recreated image they are evaluating.

After all criteria have been read, points are awarded to each of the artists according to the number of criteria satisfied by their recreated image. Additional points are awarded for satisfying the bonus criterion. The describer is awarded points according to the number of criteria that had been satisfied by any of the artists' recreated images.

Play continues until all participants have had the same number of opportunities to assume the role of describer. Each participant adds the points that they received during all rounds of play, regardless whether the player acted as describer or artist during a round. The participant with the most total points is declared the winner.

BRIEF DESCRIPTION OF THE DRAWINGS

In order to obtain complete understanding of the nature and objects of the present invention, reference is made to the following drawings in which parts are given numerals, and wherein.

DETAILED DESCRIPTION OF THE PREFERRED EMBODIMENTS

Before explaining in detail the present invention, it is to be understood that the invention is not limited in its application to the details illustrated in the accompanying drawings, since the invention is capable of other embodiments and of being practiced or carried out in various ways. Also, it is to be understood that the phraseology and terminology employed herein is for purpose of description and not limitation.

Figure 1:
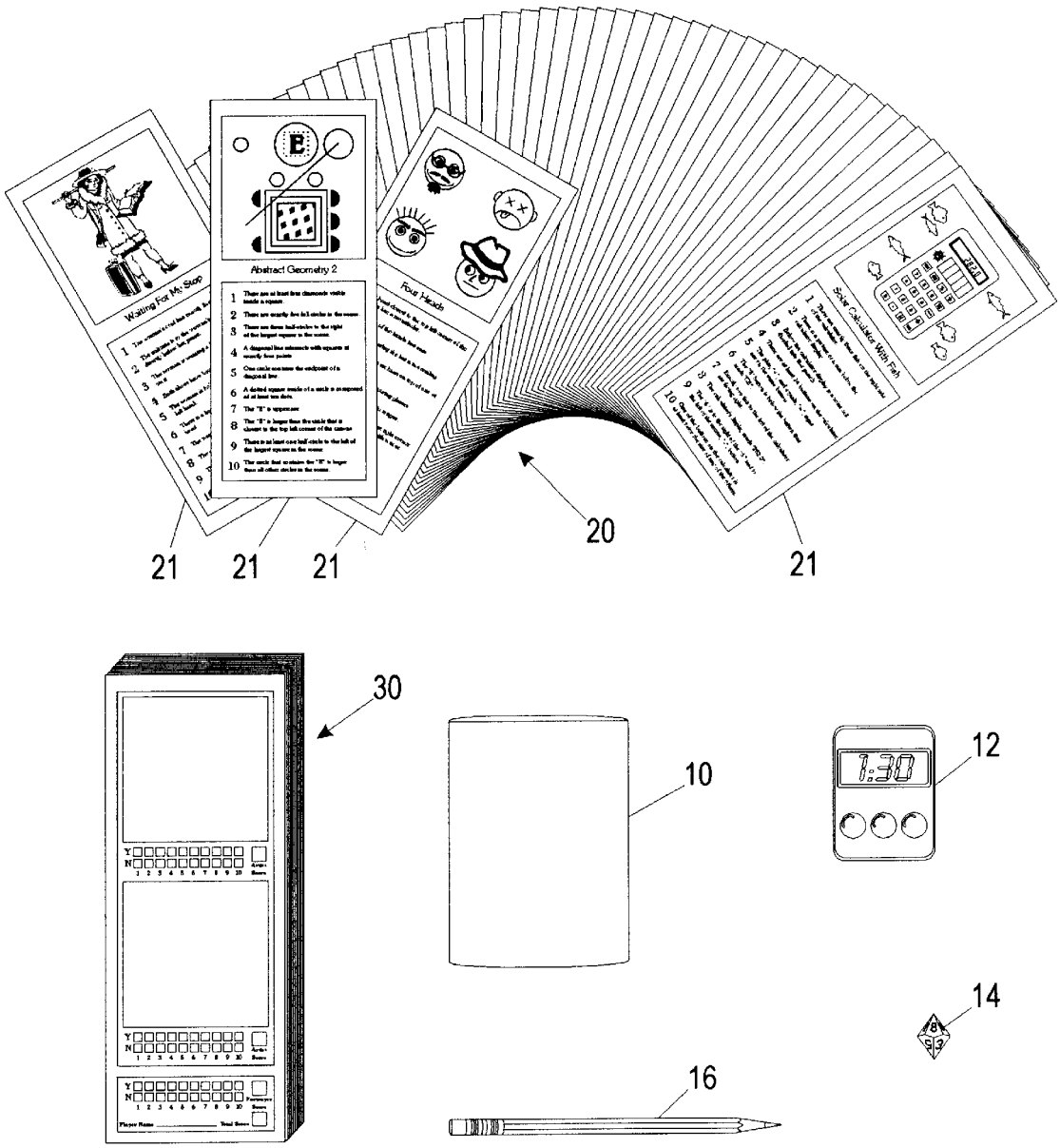
FIG. 1 is a plan view of the game apparatus according to an embodiment of this invention.
Figure 2A:
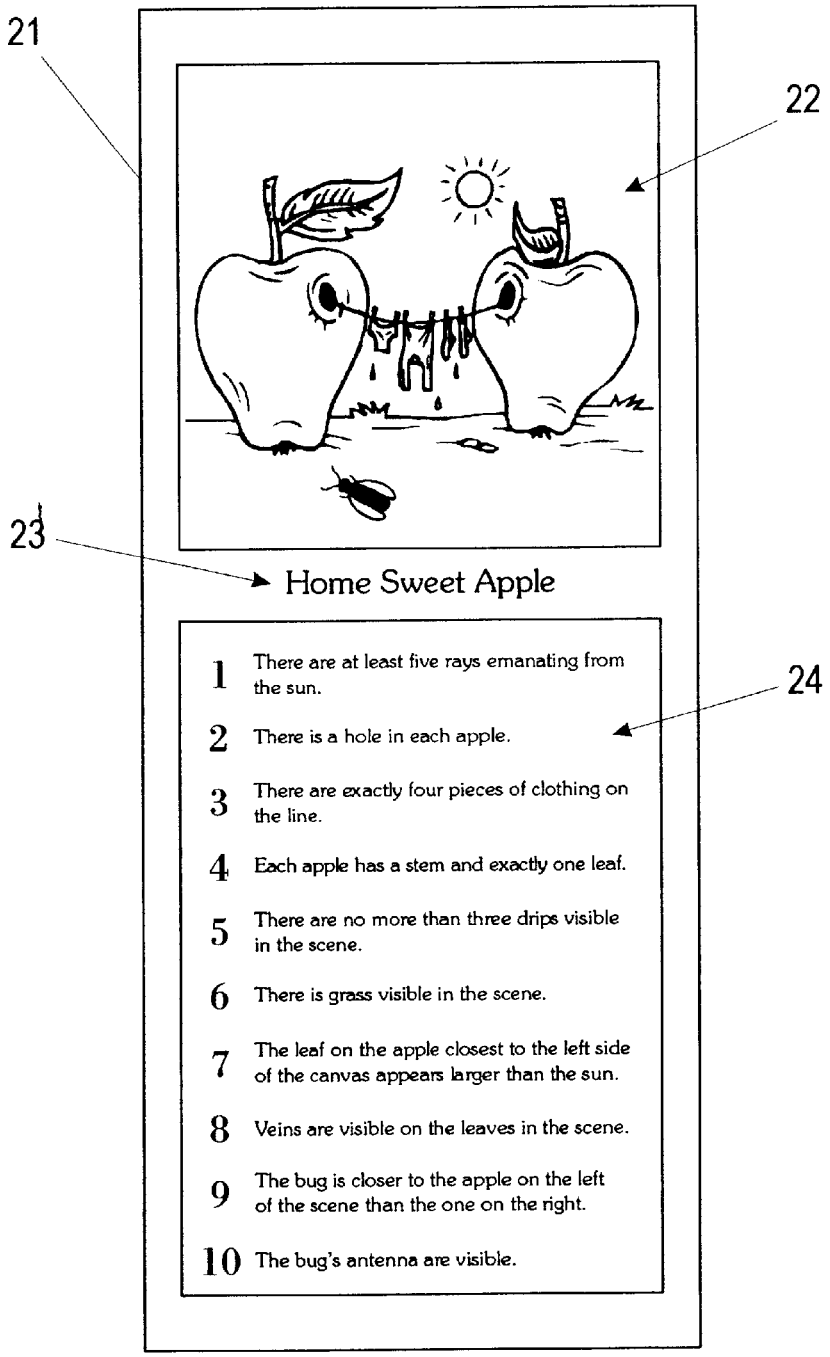
FIG. 2*a* is a front plan view of a sample game card.
Figure 2B:
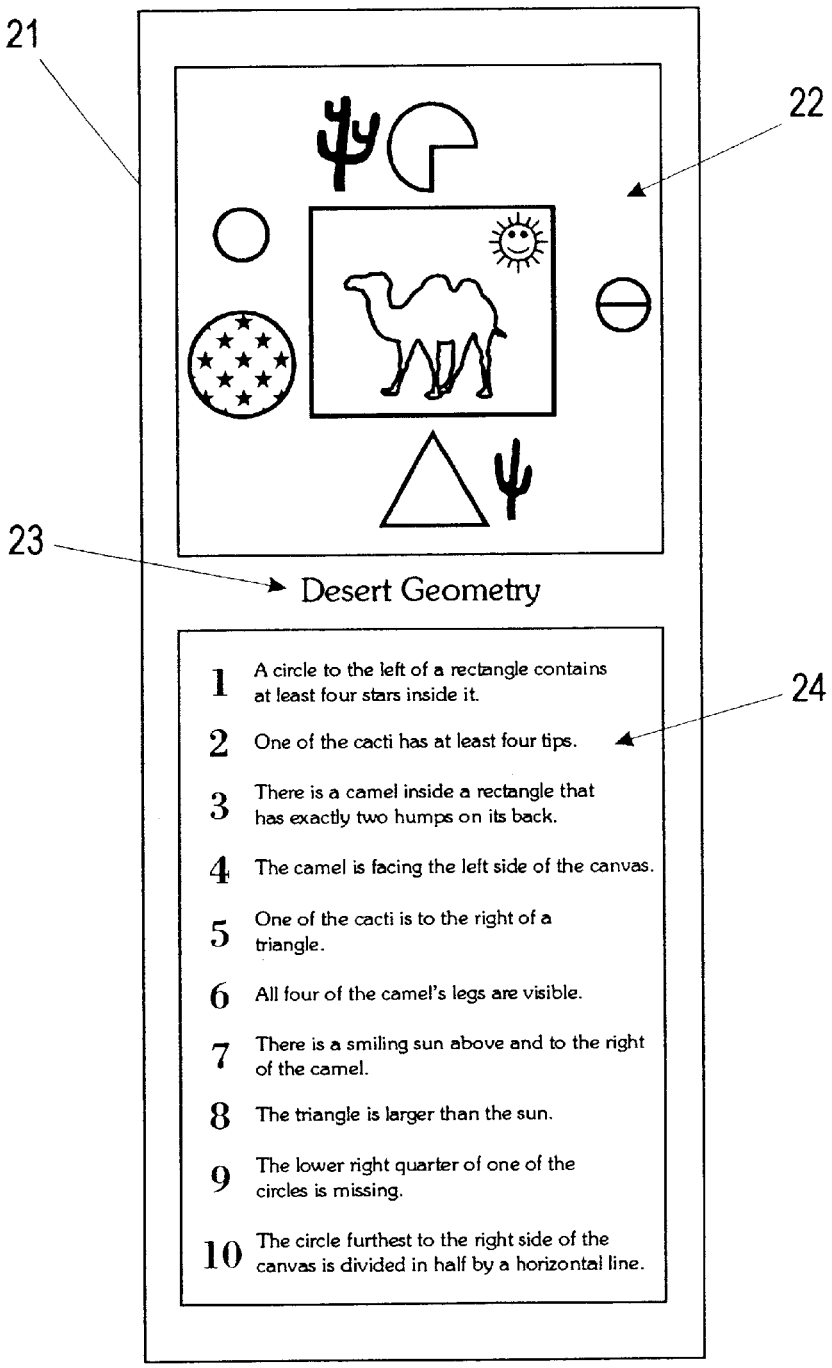
FIG. 2*b* is a view similar to FIG. 2*a* of another sample game card.

Referring to the drawings and particularly to FIG. 1, there is illustrated a preferred embodiment of a game apparatus constructed in accordance with the present invention. The game apparatus includes a card set 20 containing a plurality of game cards. In FIG. 1, the cards have been arranged for presentation purposes. Examples of four individual game cards 21 are shown. Further examples of two game cards 21 are depicted in FIGS. 2*a*–2*b*. There is no limit on the number of cards contained in the set 20. For a wide selection of cards while retaining ease of storage and portability, a set comprising from 100 to 500 cards is very satisfactory. Preferably, the entire set of game cards 20 is conveniently contained in a deck holder constructed to facilitate drawing individual cards from the stack. The deck holder is not shown, but suitable deck holders capable of being used with the present invention are well known in the art. The game apparatus also includes a plurality of writing surfaces 30. The writing surface is further depicted in FIG. 3. The game apparatus also includes a concealment folder 10, which is further depicted in FIG. 4. The game apparatus also includes a timer 12 that is used to limit the duration of gameplay. In a preferred embodiment, the timer 12 would provide a visual and/or audible signal upon the expiration of a predetermined fixed time period. Timers of this nature are common in prior art and include both electrical and mechanical versions. The game apparatus preferably also contains a multi-sided die 14 that is rolled to randomly select the bonus criterion. Multi-sided dice are well known in the art. A set of writing utensils 16 is provided as part of the preferred game apparatus. Appropriate writing utensils are also common in prior art and could be eliminated as a component of the game apparatus because it would be trivial for participants to obtain writing utensils from other sources.

Referring to FIG. 2*a*, attention is directed to a sample game card 21. The game card 21 includes an image 22, an image title 23, and a series of numbered criteria 24. There are no limitations on the nature of the image 22 on a game card, and an image may be realistic, fantastical, geometric, humorous, symbolic, etc. Each criterion 24 is a true statement of a descriptive nature pertaining to the image 22 on the same card. There are no limitations on the nature of a single criterion and it may address number, relative sizes, locations, etc. of features in the image 22 and may be objective or subjective. For example, the image 22 on the game card 21 depicted in FIG. 2*a* is of two apples joined by a clothesline and is titled "Home Sweet Apple". The second criterion on the card is "There is a hole in each apple."

FIG. 2*b* illustrates another sample game card 21. The game card 21 includes an image 22, an image title 23, and a series of numbered criteria 24. For example, the image 22 on the card 21 depicted in FIG. 2*b* is of several shapes, two cacti, a camel, and a sun and is titled "Desert Geometry". The eighth criterion on the card is "The triangle is larger than the sun."

Figure 3:
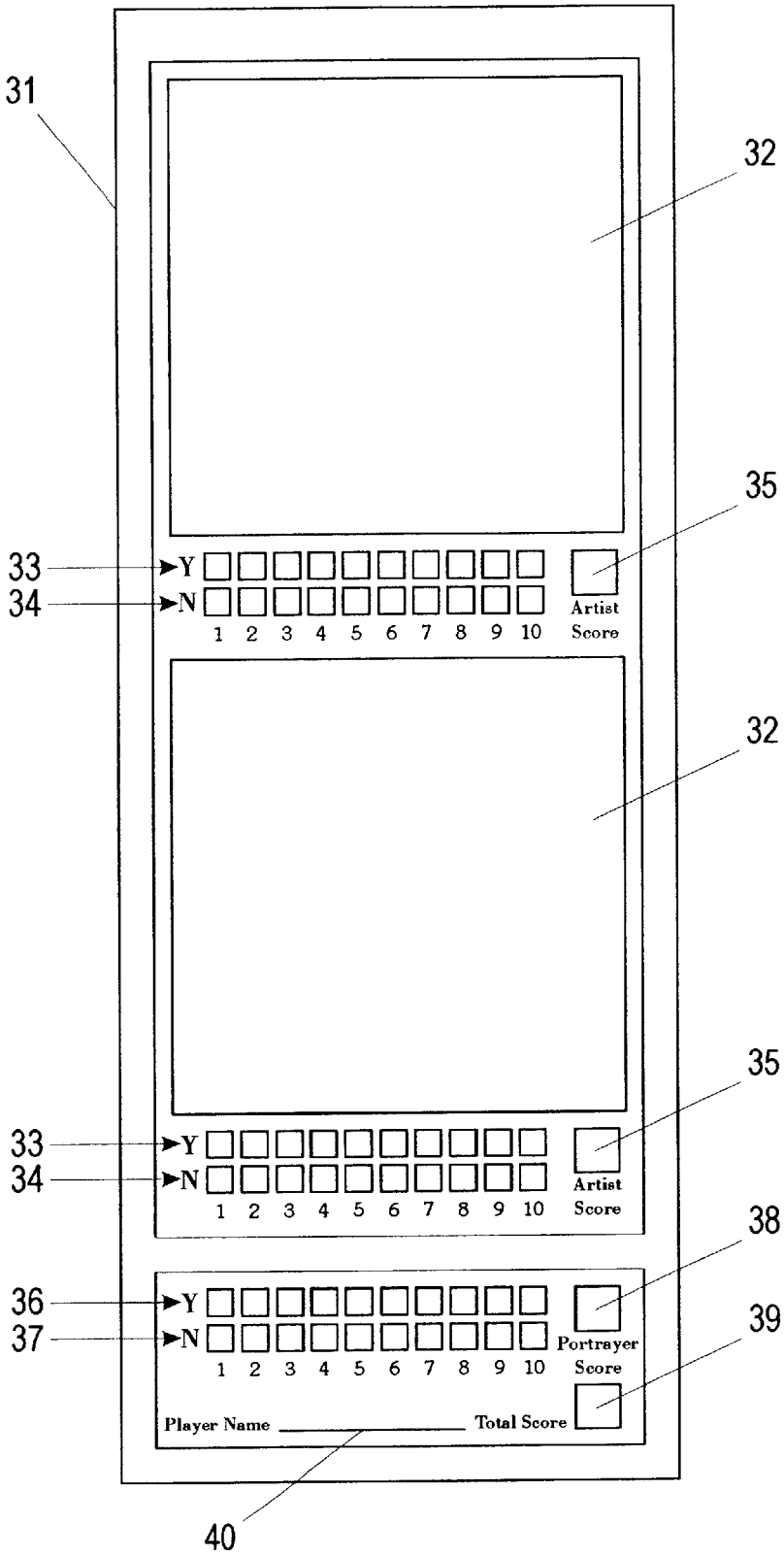
FIG. 3 is a front plan view of the writing surface.

FIG. 3 illustrates the game writing surface 31. A designated area 32 is provided within which a participant is to recreate an image based on a verbal description. A set of numbered checkboxes labeled with a 'Y' 33 is provided to be used to record that a particular criterion has been satisfied by the recreated image. A set of numbered checkboxes labeled with an 'N' 34 is provided to be used to record that a particular criterion has not been satisfied by the recreated image. For example, if the image recreated by a participant satisfied criterion number three, a check would be placed in the third check box among the set of boxes labeled with the 'Y' 33 on said participant's writing surface beneath said participant's recreated image. If the image did not satisfy criterion number three, a check would be placed in the third check box among the set of boxes labeled with the 'N' 34 on said participant's writing surface beneath said participant's recreated image. The total score earned by a participant who has recreated an image based on a verbal description is entered as a number in the box 35 provided. In a preferred embodiment, there are two identical regions of the nature described above, each region being used during separate rounds of gameplay; however, alternative valid embodiments of the writing surface could include more or fewer of such regions.

Also shown in FIG. 3 of a writing surface 31 is a set of numbered checkboxes labeled with a 'Y' 36 provided to be used to record that a particular criterion has been satisfied by at least one of the recreated images. A set of numbered checkboxes labeled with an 'N' 37 is provided to be used to record that a particular criterion has not been satisfied by any of the recreated images. For example, if one or more participants' recreated images satisfied criterion number three, the participant that described the image would place a check in the third check box among the set of boxes labeled with the 'Y' 36 on his or her writing surface. If no participant's recreated image satisfied criterion number three, the participant that described the image would place a check in the third check box among the set of boxes labeled with the 'N' 37 on his or her writing surface. The total score earned by a participant who has provided a verbal description of an image is entered as a number in the box 38 provided. In a preferred embodiment, the region used by a participant after having provided a verbal description is included on the writing surface along with the regions used by a participant after recreating or evaluating an image; however, alternative embodiments may provide these regions on separate distinct writing surfaces. The sum of the scores recorded on the writing surface (in boxes 35 and 38) is entered as a number in the box 39 provided. A designated area 40 is provided for a participant's name so that he or she can later identify all of his or her writing surfaces.

Figure 4:
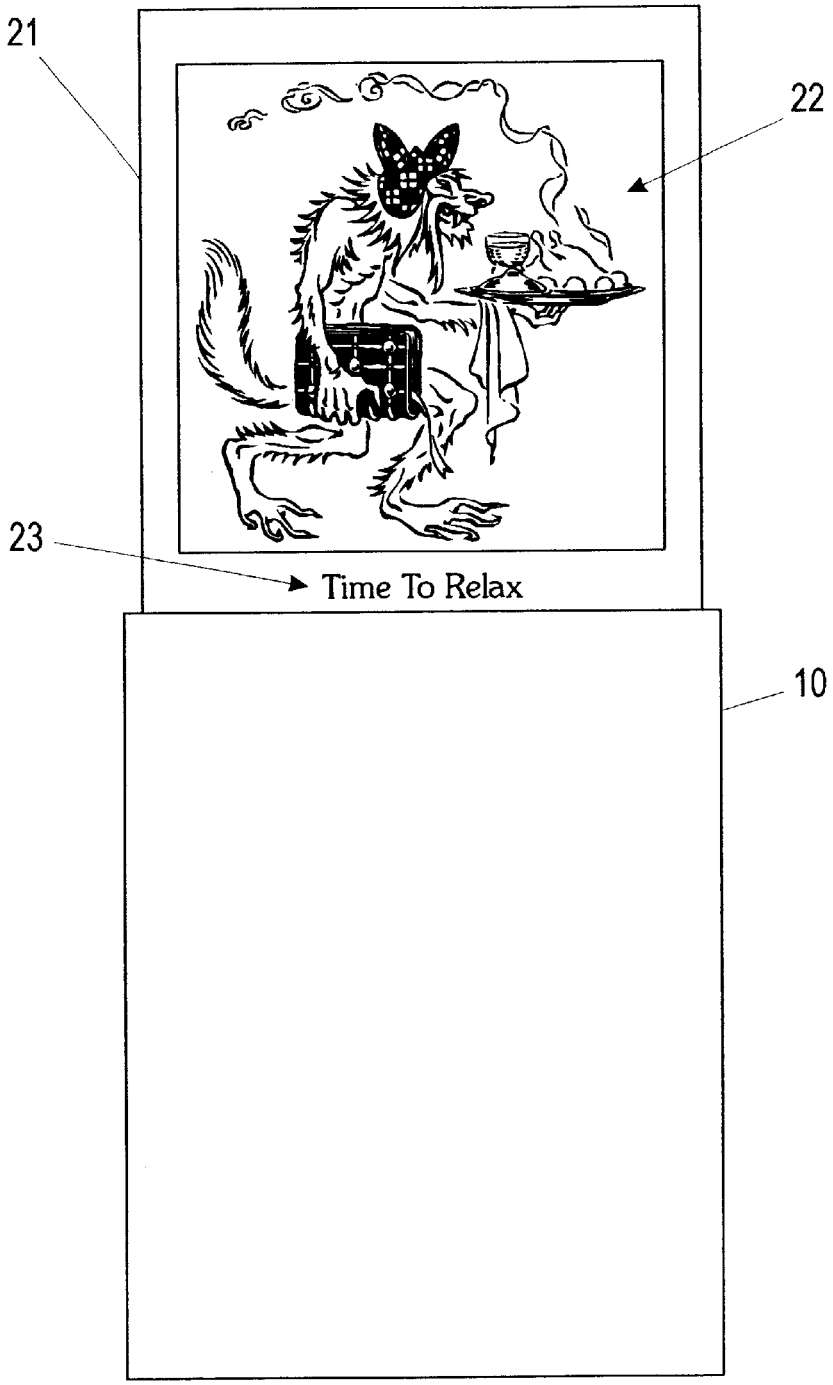
FIG. 4 is a front plan view of a sample game card inserted into the concealment folder.

FIG. 4 illustrates a game card 21 inserted into the game concealment folder 10. At the start of a round, the participant who will be describing the image selects one game card 21 from the set of game cards 20 and inserts it into the concealment folder 10 such that the image 22 and image title 23 are visible and the set of criteria 24 is not visible. The participant describing the image 22 should hold the game card 21 in the concealment folder 10 such that no other participant is able to see the image. After the participant has described the image 22, he or she removes the game card 21 from the concealment folder 10 so that all criteria 24 are visible to him or her, but not visible to the other participants. Said participant then reads each criterion in turn so that the other participants may determine whether or not the recreated image they are evaluating satisfies said criterion. Other embodiments of devices performing the function of the concealment folder 10 are possible and well known in the art.

The method of game play may best be understood by referring to FIGS. 1–4. To play the game of the present invention, there must be three or more participants. The object of the game is to accumulate points by verbally describing images, recreating images based on verbal descriptions, and evaluating images based on preexisting criteria Play begins by distributing to each participant a plurality of writing surfaces 30. and a writing utensil 16. Each participant rolls the multi-sided die 14. The participant with the highest roll is designated as the first describer, with play passing clockwise. The participants not acting as describer during any round of gameplay are designated as artists. All participants should enter their name in the space provided 40 on their writing surface 31.

In each round of play, the describer selects a game card 21 from the set of game cards 20 and inserts it into the concealment folder 10. Said describer rolls the multi-sided die 14 to determine which criterion will be worth bonus points if satisfied. Said describer then reads aloud the title of the image 23. The timer 12 is activated and made to count down the allotted time while said describer verbally describes the image 22 on the game card 21. Using their writing utensil 16, all artists attempt to recreate the image 22 in the designated area 32 on their writing surface 31 based on the verbal description provided. When the timer 12 indicates that all time has elapsed, the describer must stop talking and all artists must stop recreating the image.

When time has elapsed, the describer chooses whether the artists should pass their writing surface 31 with recreated image clockwise or counterclockwise to another artist. The describer then removes the game card 21 from the concealment folder 10 and reads aloud each criterion and criterion number 24 in the order in which they appear on the game card 21, pausing for a moment between each such that all artists have adequate time to evaluate the recreated image before them and mark the appropriate checkbox 33–34 on the writing surface 31.

When all criteria 24 have been read, the artists should count the number of criteria that have been satisfied by the recreated image they were evaluating by counting the number of checks in the 'Y' set of checkboxes 33. To this total, the artists should add two additional points if, and only if, the bonus criterion had been satisfied. The total score should be entered in the space provided 35.

For each criterion, the describer should ask if any artist's recreated image satisfied said criterion. If one or more artists' recreated images satisfied the criterion, the describer should mark the appropriate 'Y' checkbox 36 on his or her writing surface 31. If no artist's recreated image satisfied the criterion, the describer should mark the appropriate 'N' checkbox 37 on his or her writing surface 31. The describer should count the number of checks in the 'Y' set of checkboxes 36 and record this amount as their score for the round in the space provided 38 on the writing surface 31.

After all scores have been recorded, play proceeds clockwise with the next participant assuming the role of describer while all other participants assume the role of artist. After each participant has had an equal number of opportunities to describe an image (typically one chance), all participants should sum each of their final round scores. The total score for each writing surface should be entered in the space provided 39. A participant's grand total score is calculated by summing all of the total scores on each of their writing surfaces. The winning participant is the one with the highest grand total score.

The previously described version of the present invention provides several advantages over games currently available that involve activities of describing images and drawing. First, because the game of the present invention allows participants to describe an image using any vocabulary within a specified time limit, the game is more entertaining and challenging to participants who must learn to describe images very concisely. The game of the present invention involves sophisticated images often of a humorous nature that enhance the enjoyableness of the game. Finally, the game of the present invention involves the activity of evaluating participant-created images based on preexisting criteria. This feature is not available in other games and adds to the interactive and social aspects of the game.

From the foregoing description, it may be seen that a game formed in accordance with the present invention incorporates many novel features and offers significant advantages over those currently available. While the presently preferred embodiment of the invention has been illustrated and described, it is to be understood that within the scope of the appended claims, various changes can be made therein without departing from the scope of the invention. Possible examples of other variations and/or versions are a different timer, different die, different writing utensils, different languages, a children's version, and themed versions. The game of the present invention may also be configured as a multi-media game and, therefore, other embodiments, such as a computer-based playing environment (e.g. a software game for a personal computer or for a computer network) or a television-based playing environment, are also within the scope of the present invention.

What is claimed is:

1. A method of game play comprising the steps of:

a. distributing to each participant a plurality of writing surfaces, each writing surface bearing:

i. one or more designated regions within which participants acting as artists are to recreate an image based on a verbal description;

ii. one or more designated regions within which participants acting as artists are to record whether or not each particular criterion has been satisfied by a particular recreated image;

iii. one or more designated regions within which a participant acting as a describer is to record whether or not each particular criterion has been satisfied by any recreated image;

iv. one or more designated regions within which is to be recorded the total number of points awarded to a participant acting as an artist who has recreated an image based on a description;

v. one or more designated regions within which is to be recorded the total number of points awarded to a participant acting as a describer who has described an image;

b. selecting a game card from the set of game cards, each game card bearing:

i. a unique image;

ii. an image title;

iii. a plurality of unique written criteria, each criterion being a true statement of a descriptive nature pertaining to the unique image on the same card;

c. selecting one of the written criteria as the bonus criterion;

d. reading aloud to all participants the title of the image on the selected game card;

e. verbally describing the image on the selected game card using an unrestricted vocabulary;

f. recreating the image on the writing surfaces based on the verbal description provided;

g. exchanging the recreated images among the participants who acted as artists such that no participant retains his or her own recreated image;

h. reading aloud the criteria on the game card one by one in the order that the criteria appear on the game card;

i. evaluating the recreated images to determine if the criteria are satisfied by said recreated image;

j. allocating points to participants who acted as artists based on the number of criteria satisfied by their recreated image;

k. allocating additional points to participants who acted as artists if the bonus criterion was satisfied by their recreated image;

l. allocating points to the participant who acted as describer based on the number of criteria satisfied by one or more of the recreated images.

2. The method of game play of claim 1, wherein the plurality of written criteria on the selected game card are concealed from all participants until after the image has been described.

3. The method of game play of claim 1, wherein the image on the selected game card is concealed from all participants acting as artists until after the image has been described.

4. The method of game play of claim 1, wherein all participants acting as artists are required to refrain from speaking while the participant acting as a describer describes the image.

5. The method of game play of claim 1, wherein the participant acting as a describer is required to refrain from using gestures while he or she describes the image.

6. The method of game play of claim 1, wherein the activities of verbally describing the image and recreating the image be allotted no more time than that measured by a timing device.

7. The method of game play of claim 1, wherein all participants are given an equal number of opportunities to act as a describer before concluding the game.

8. The method of game play of claim 1, wherein at the conclusion of the game the participant with the largest total number of points is declared the winner.

* * * * *